US009321066B2

(12) United States Patent
Gaywala et al.

(10) Patent No.: US 9,321,066 B2
(45) Date of Patent: Apr. 26, 2016

(54) DRUG COATING APPARATUS

(71) Applicant: SAHAJANAND TECHNOLOGIES PRIVATE LIMITED, Surat (IN)

(72) Inventors: Rahul Mahendrakumar Gaywala, Surat (IN); Vallabh Mohan Narola, Surat (IN)

(73) Assignee: SAHAJANAND TECHNOLOGIES PRIVATE LIMITED, Surat (IN)

( * ) Notice: Subject to any disclaimer, the term of this patent is extended or adjusted under 35 U.S.C. 154(b) by 0 days.

(21) Appl. No.: 14/379,031

(22) PCT Filed: Feb. 15, 2013

(86) PCT No.: PCT/IN2013/000100

§ 371 (c)(1),
(2) Date: Aug. 15, 2014

(87) PCT Pub. No.: WO2013/121445

PCT Pub. Date: Aug. 22, 2013

(65) Prior Publication Data

US 2015/0027368 A1 Jan. 29, 2015

(30) Foreign Application Priority Data

Feb. 16, 2012 (IN) ..... 436/MUM/2012

(51) Int. Cl.
*B05B 3/00* (2006.01)
*B05B 3/14* (2006.01)
(Continued)

(52) U.S. Cl.
CPC ..... *B05B 12/02* (2013.01); *B05B 12/004* (2013.01); *B05B 13/0228* (2013.01); *B05B 13/0405* (2013.01); *B05B 13/0415* (2013.01); *B05B 15/008* (2013.01); *B05B 15/02* (2013.01); *B05B 15/025* (2013.01); *B05B 15/1203* (2013.01); *B05B 15/1248* (2013.01); *B05C 13/02* (2013.01); *B05B 7/02* (2013.01)

(58) Field of Classification Search
USPC ..... 118/320, 321, 323, 500, 686, 663; 427/2.24, 2.25, 2.28, 2.3, 424, 385.5, 427/398.4, 398.1; 623/1.42–1.46
See application file for complete search history.

(56) References Cited

U.S. PATENT DOCUMENTS 7,504,125 B1 * 3/2009 Pacetti et al. ..... 427/2.24
7,569,110 B2 * 8/2009 Shekalim et al. ..... 118/697
(Continued)

FOREIGN PATENT DOCUMENTS

WO 2007/100838 A2 9/2007
WO 2009/085618 A2 7/2009
WO 2011/019851 A1 2/2011

OTHER PUBLICATIONS

International Search Report for corresponding International Application No. PCT/IN2013/000100, mailed Aug. 16, 2013 (3 pages).

*Primary Examiner* — Yewebdar Tadesse
(74) *Attorney, Agent, or Firm* — Osha Liang LLP

(57) ABSTRACT

A drug coating apparatus (100) for coating an implant (206) with a drug is described. The drug coating apparatus (100) includes a holding unit (102) having a top collet (202-1) for holding the implant (206) from a top end of the implant (206), and a bottom collet (202-2) to hold the implant (206) from a bottom end of the implant (206). The drug coating apparatus (100) includes at least one rotary drive (115) coupled to the holding unit (102) for rotating the top collet (202-1), the bottom collet (202-2) and the implant (206), and includes a spraying unit (104) to spray-coat the drug on the implant (206).

15 Claims, 4 Drawing Sheets

(51) Int. Cl.

| | |
|---|---|
| ***B05B 12/02*** | (2006.01) |
| ***B05B 13/02*** | (2006.01) |
| ***B05B 13/04*** | (2006.01) |
| ***B05B 15/02*** | (2006.01) |
| ***B05B 15/12*** | (2006.01) |
| ***B05B 12/00*** | (2006.01) |
| ***B05B 15/00*** | (2006.01) |
| ***B05C 13/02*** | (2006.01) |
| *B05B 7/02* | (2006.01) |

(56) References Cited

U.S. PATENT DOCUMENTS

| | | | | |
|---|---|---|---|---|
| 2004/0018803 | A1* | 1/2004 | Boumerzoug et al. | 451/39 |
| 2006/0147620 | A1* | 7/2006 | Kwon et al. | 427/162 |
| 2006/0216403 | A1* | 9/2006 | Hayes | 427/2.1 |
| 2007/0259102 | A1 | 11/2007 | McNiven et al. | |
| 2007/0275175 | A1* | 11/2007 | Hossainy | 427/425 |
| 2009/0035449 | A1 | 2/2009 | Chen et al. | |
| 2010/0015333 | A1* | 1/2010 | McMorrow | 427/248.1 |
| 2010/0034960 | A1* | 2/2010 | Kindaichi et al. | 427/2.25 |

* cited by examiner

DRUG COATING APPARATUS

TECHNICAL FIELD

The present subject matter, in general, relates to a coating apparatus and, particularly but not exclusively, to a drug coating apparatus for coating of drugs on implants.

BACKGROUND

Medical implants are used for a variety of treatments in human body. An example of a medical implant is a stent which is like an artificial tube, inserted into a natural passage in the body to prevent, or counteract, a disease-induced, localized flow constriction. One or more of such stents may be placed into blocked arteries in a body in order to flush out blockage and rejuvenate the working of the blocked arteries. The medical implants are usually coated with a medical drug before being placed in a body part that needs to be treated. With time, the drug is gradually released from the surface of the medical implant into the body part. For example, a drug coated peripheral or coronary stent is placed into narrowed, diseased peripheral or coronary artery and the drug is slowly released to control the blockage.

Typically, pharmaceutical industries use coating apparatuses that implement coating processes for coating bare stents with medical drugs. Commonly known coating processes include spray coating and immersion coating of liquid medical drugs on the stents. Quality of coating is defined in terms of the degree of uniformity of the drug layer coated on a stent. Thus, for obtaining drug coatings of a substantially good quality, the drug has to be coated on the stent with substantial uniformity.

SUMMARY

This summary is provided to introduce concepts related to a drug coating apparatus. This summary is neither intended to identify essential features of the claimed subject matter nor is it intended for use in determining or limiting the scope of the claimed subject matter.

In accordance with an implementation of the present subject matter, a drug coating apparatus is described. The drug coating apparatus includes a holding unit having a top collet for holding the implant from a top end of the implant, and a bottom collet to hold the implant from a bottom end of the implant. The drug coating apparatus includes at least one rotary drive coupled to the holding unit for rotating the top collet, the bottom collet and the implant, and includes a spraying unit to spray-coat the drug on the implant.

BRIEF DESCRIPTION OF DRAWINGS

The detailed description is described with reference to the accompanying figures. The same numbers are used throughout the figures to reference like features and components. Some implementation of apparatus in accordance with the present subject matter are now described, by way of example only, and with reference to the accompanying figures, in which:

FIG. 1(*b*) illustrates a detailed view of the apparatus without a holding unit, according to an implementation of the present subject matter.

DETAILED DESCRIPTION

Figure 1A:
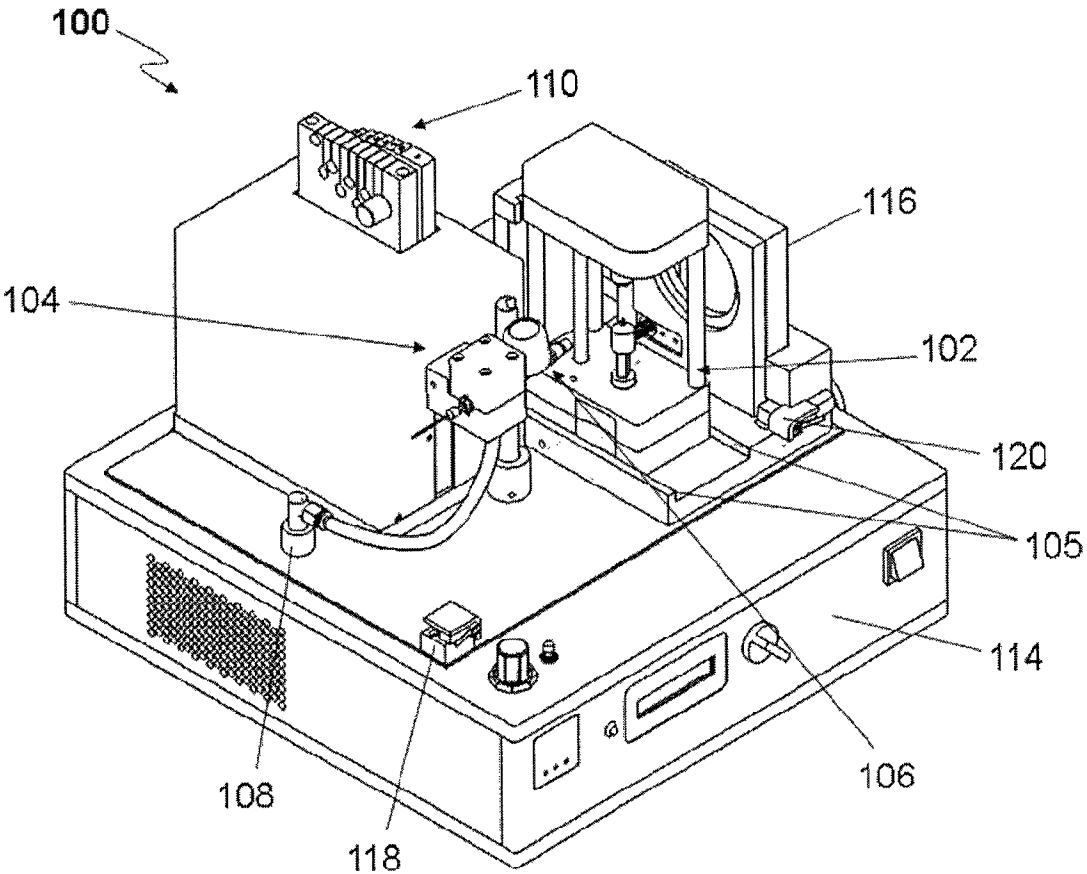
FIG. 1(*a*) illustrates a perspective view of an apparatus for coating a medical implant with a drug, according to an implementation of the present subject matter.

Generally, drug coated medical implants, such as medicated stents, find applications in a variety of treatments. For example, medicated stents may be employed for treating restenosis. For treatment purposes, the drug coated medical implants may be placed in blocked arteries where drug is gradually released for rejuvenation of the blocked arteries. A medicated stent may be fabricated by coating the surface of the stent with a drug composition. The drug composition may include a polymer solution, and an active agent dispersed in the polymer solution. For the sake of simplicity, the term 'drug composition' is referred to as 'drug' in the description hereinafter.

Typically, the drug is coated applied on the medical implant through a spray coating process or an immersion coating process. In the immersion coating process, the stent is immersed in the drug. In the spray coating process the drug is sprayed onto the stent using a spraying device. The spraying device includes a spray gun for spraying the drug onto the stent. Further, in the spray coating process, the stent, for being coated with the drug may be held in a fixture and rotated. The fixture may be understood as a means to hold the stent for the purposes of coating the drug on to the stent. The rotation may be performed in order to obtain a coating of the drug on the entire surface of the stent.

Conventional techniques for coating a medical implant by a drug using a spraying device may include manual controlling of rotation of the medical implant held in a fixture. Further, parameters such as the amount of drug to be sprayed, and the angle of spraying the drug on the medical implant may also be manually controlled. In an example, in order to drug-coat a stent, the amount of drug to be coated onto the stent may be controlled by successive manual starting and stopping the spraying device for fixed periods of time.

Conventionally, the fixture for holding the medical implant may have one or more wires to hold the medical implant from a top end and a bottom end of the medical implant. Holding the medical implant with wires may result in improper coating of the medical implant with the drug. For example, improper coating may occur due to twisting of the wires while the medical implant is rotated. The twisting of one or more wires may cause recoiling of the wires, which may result in extra rotations of the medical implant in a direction opposite to desired direction of rotation. Further, in order to prevent the rotation of the medical implant in the direction opposite to the desired direction of rotation, the medical implant may be dismounted from the fixture after every single rotation and re-mounted for further coating. This may be time consuming, and hence, may affect production of the drug coated medical implants.

In addition, in conventional techniques for drug-coating of medical implants, uncontrolled and non-uniform coating of drug on the medical implants may occur due to the manual operations, such as handling of the spraying device and rotation of the medical implant. The non-uniform thickness of drug onto the circumference of the medical implant may cause an irregular amount of drug to enter the blood stream over a period of time through the medical implant, which may adversely affect the health.

Further, the spraying device includes an atomizer to atomize the drug to be coated onto the medical implant. The atomizer atomizes the drug to produce small droplets of drug. Atomization may be used such that the size of a droplet of the drug in a spray cycle is made substantially smaller than the surface area of a portion of the medical implant to be coated. This facilitates a substantially conformal coating of the drug on to the implant. However, there may be hazards associated with the manual spray coating of the medical implant with the atomized drug. For instance, certain compounds in the drugs, particularly the polymers therein, that are coated onto the medical implants are toxic in nature. As the spraying of drugs is controlled manually, the atomized drugs may be inhaled by the users performing the drug-coating process. Such exposure of the users conducting the coating process to the drugs may result in health hazards. Conventionally, hoods, glove boxes, enclosures, and shrouds can be used to prevent inhalation of toxic drugs by the users, but at the cost of decreased efficiency and increased expenditures on equipment.

Further, conventionally, the drug to be coated on the medical implant may be wasted when the spraying process is carried out manually. The wastage of drug may occur due to improper handling of the spraying device. For example, the drug may be wasted if the spraying device is not substantially directed towards the medical implant. With this, only a fraction of the drug is effectively coated on the medical implant and a substantial portion of the drug is wasted. The wastage of the drug may result in an increase in the overall cost of the drug-coating process.

A drug coating apparatus for coating a medical implant with a drug is described herein. The medical implant may include a stent. For the sake of simplicity, the medical implant is interchangeably referred to as the implant.

In an implementation, the drug coating apparatus may include a holding unit for holding the implant for coating a drug on the implant. The implant is held firmly in the holding unit in a manner such that the implant may be rotated about an axis in order to uniformly coat the drug onto a peripheral surface of the implant. In an example, the implant may be held substantially vertical and may be rotated about a central longitudinal axis for the purpose of coating of the drug. In an implementation, the holding unit may include a pair of holding elements, such as collets. The pair of holding elements includes a top collet for holding the implant from its top end and includes a bottom collet for holding the implant from its bottom end.

In an implementation, the implant, at each of its ends, may be coupled to a thin spring wire. The free end of the thin spring wire at each end of the implant is coupled to a locator. The locator at each end of the implant is coupled to one of the holding elements, i.e., the collets. The locators are the intermediate coupling means that set the location of the implant in the holding unit for coating of drug. The components in the holding unit, including the spring wires, locators, collets, and the couplings therebetween, are such that the implant is held substantially firmly for the purposes of coating the drug on to the implant. The couplings and the components in the holding unit facilitate in mounting and un-mounting of implant is substantially easy manner. In an implementation, the locators may be attached to the holding elements by means of magnetic coupling or a vacuum sealing.

Further, in an implementation, the drug coating apparatus includes one or more rotary drives for rotating the implant while coating of the implant with the drug. The implant, mounted in the holding unit, is rotated at a predefined rotational speed about, say a central longitudinal axis of the implant. The rotary drive is coupled to the holding unit such that the holding elements, i.e., the collets holding the implant, are rotated by the rotary drive. The implant is then rotated by the rotation of the holding elements. The one or more rotary drives rotate the holding elements in conjunction with each other in order to uniformly rotate the implant at the predefined rotational speed. In an example, the rotary drives may be stepper motors which are controlled by a control mechanism, say a programmable micro-controller. As the rotary drives are controlled through the control mechanism, irregular rotations of the implant may be substantially eliminated.

In an implementation, the holding unit may be detachably attached to the drug coating apparatus. With such attachment of the holding unit to the drug coating apparatus, while a spray cycle for an implant in one holding unit is in progress, another holding unit with another implant to be coated may be prepared separately for coating. When the drug-coating on one implant is over, the holding unit may be detached from the drug coating apparatus, and the other holding unit is attached to the drug coating apparatus. Such a provision may assist in efficient coating of medical implants one after another, which facilitates in reducing the time between the coatings of two medical implants.

In an implementation, the drug coating apparatus comprises a spraying unit for spray-coating the drug on the implant. The spraying unit includes a spray gun with a nozzle through which the drug is spray-coated on the implant. In an implementation, the spray gun and the holding unit are configured such that the axis of the implant, about which the implant is rotated, substantially coincides with the direction of spray of the drug from the spray gun.

Further, the drug coating apparatus is configured with a swinging mechanism for swinging the spray gun along a longitudinal axis of the implant during the drug-coating process. During operation, the spray gun is swung through an angle of swing, the angle of swing being selected such that the entire length of the implant is covered by the drug spray. The swing motion facilitates in coating of the drug with a substantial uniformity on the entire surface of the implant. The swing motion of the spray gun is automated. In an implementation, the swinging mechanism in the drug coating apparatus provides for varying the angle of swing of the spray gun based on a length of implant to be coated. The angle is swing is set such that the drug spray from the spray gun moves angularly from one end of the implant to the other end of the implant during the drug-coating process.

The spray gun may further include an atomizer for atomization of the drug before spraying the drug on to the implant for drug-coating. The spray gun may further include an inlet for providing pressurized air into the atomizer. The pressurized air may be provided into the atomizer in order to atomize the drug for coating on the implant. Further, in an implementation, the pressure at which the air is released into the atomizer may be controllable. Such a provision controls the atomization rate of the drug, which in turn may ensure that only a fix amount of drug with a substantial uniformity is released and coated onto the circumference of the implant. In an implementation, a pressure gauge is provided in the drug coating apparatus to measure the pressure of air entering the atomizer for atomizing the drug.

Further, in an implementation, pressurized nitrogen gas or any other gas may be used for the purpose of atomization of the drug. The pressure of nitrogen gas or the other gas may be selected based on the amount of drug to be coated on the implant and, hence, on the extent of atomization of the drug required for drug-coating.

In an implementation, the drug coating apparatus includes a control unit for controlling various operational parameters of the drug coating apparatus. The operational parameters of the drug coating apparatus include rotational speed or number of rotations per minute (RPM) of the implant, air or gas pressure to be released into the atomizer, speed of swinging motion of the spray gun, and time period of coating a drug. In an example, the control unit may be a programmable micro-controller. The programmable micro-controller may be programmed for the operational parameters of the drug coating apparatus, as mentioned above. With the operational parameters being controlled by the control unit, the drug coating apparatus is configured to operate or function with minimum manual interventions. With the drug coating apparatus of the present subject matter a substantially uniform coating of the drug on the implant is obtained in an efficient manner.

In an implementation, the drug coating apparatus is configured to initiate for cleaning the spray gun, particularly the nozzle of the spray gun through which the spray of the drug is released. To initiate the cleaning of the spray gun, the control unit automatically puts the drug coating apparatus in standby and provides an indication to the user to perform the cleaning procedure. The drug coating apparatus may be configured to automatically initiate for cleaning of the spray gun, say the nozzle of the spray gun, periodically during the operation of the drug coating apparatus In an example, the spray gun can be cleaned before starting a spray cycle and/or after completing a spray cycle for drug-coating of a medical implant, based on the user input. The spray cycle may be understood as process cycle from the start to the completion of coating of a drug on a medical implant. In another example, the spray gun can be cleaned after the completion of a predefined number of spray cycles, or after performing the drug-coating process for a predefined time duration.

In an implementation, the spray gun can be cleaned based on an input from a user for cleaning of spray gun. Based on the user input, the control unit puts the drug coating apparatus in standby and provides an indication to the user to perform the cleaning procedure.

In an implementation, the drug coating apparatus is housed within a glass cover. The glass cover may be understood as a glass housing. The glass cover may ensure the drug-coating process takes place in a substantially clean environment inside the glass cover. The glass cover may also ensure that the drug that is sprayed on the implant is not released outside in the surrounding environment.

Further, in an implementation, the glass cover may include one or more glass doors in the glass cover. The glass doors are opened and closed using one or more door interlocks. Through the glass door(s), the user can perform various actions, including attaching and detaching of the holding unit, settings in the swinging mechanism, and the other actions during operation of the drug-coating process. If, during the spray cycle, the glass door is unintentionally left open, the drug coating apparatus may be configured to generate an alarm to indicate that the glass door is open. In an implementation, till the glass door is open, the spray cycle may be paused and the spraying of drug may not take place.

These and other advantages of the present subject matter would be described in a greater detail in conjunction with the following figures. It should be noted that the description and figures merely illustrate the principles of the present subject matter.

Figure 1B:
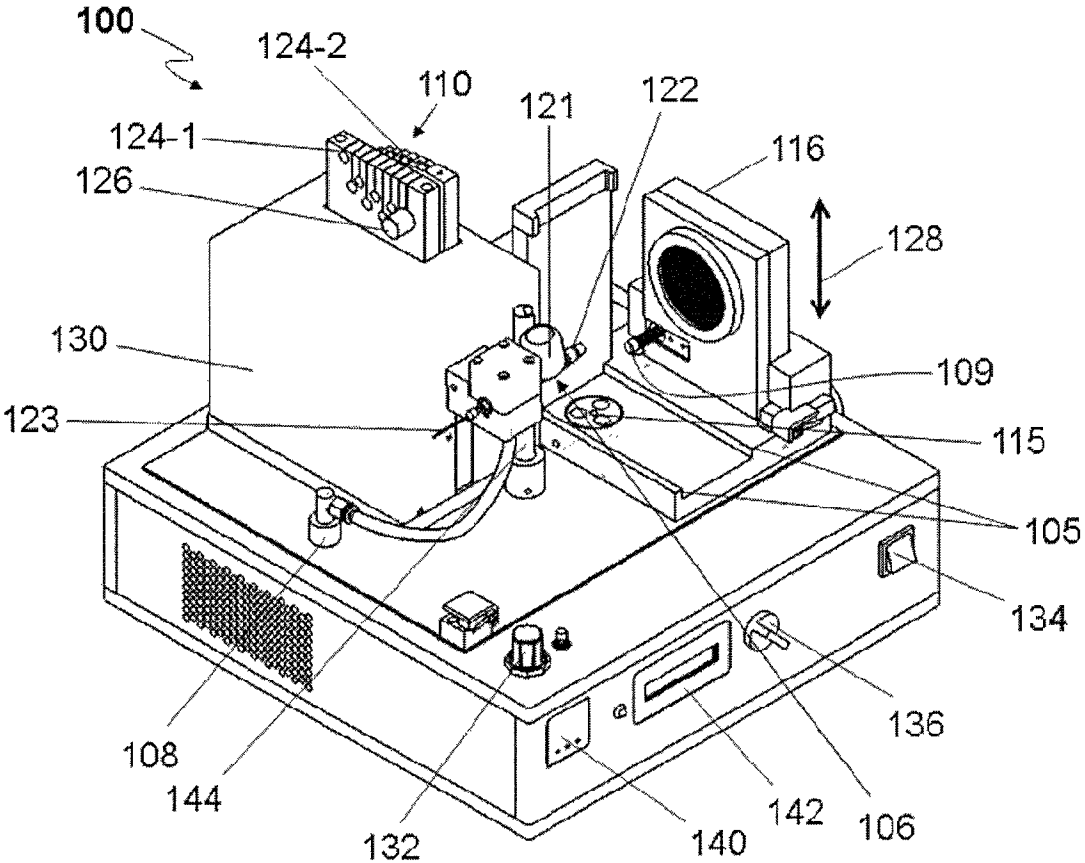

FIGS. 1(*a*) and 1(*b*) show perspective views of a drug coating apparatus 100 for coating a medical implant with a drug, according to an implementation of the present subject matter. FIGS. 1(*a*) and 1(*b*) show various components of the drug coating apparatus 100. According to an implementation, the drug coating apparatus 100, herein referred to as the apparatus 100, includes a holding unit 102, a spraying unit 104, and a control unit 114. The holding unit 102 holds a medical implant, referred to as the implant, for coating a drug on the surface of the implant. The spraying unit 104 is configured to spray-coat the drug on the implant. The control unit 114 also controls various operational parameters of the apparatus 100 for the purposes of performing the drug-coating process, in accordance with the present subject matter. FIG. 1(*b*) illustrates a detailed view of the apparatus 100 without the holding unit 102, according to an implementation of the present subject matter.

In an implementation, the holding unit 102 may be detachably attached to the apparatus 100. In an example, the holding unit 102 may be detachably attached to the apparatus 100 through a sliding mechanism. The sliding mechanism includes a grooved channel 105 provided on the base of the apparatus 100, as shown, where the holding unit 102 is positioned. The holding unit 102 is slid in the grooved channel 105 for attachment and for removal after detachment. The sliding mechanism provides for easy push and pull of the holding unit 102 on and from the apparatus 100.

Further, the apparatus 100 includes a proximity sensor 109, as shown in FIG. 1(*b*). The proximity sensor 109 is positioned to detect the alignment of the holding unit 102 when attached to the apparatus 100 and generate a signal based on the alignment. If the holding unit 102 is misaligned or not positioned incorrectly in the apparatus 100, the proximity sensor 109 conveys an error signal based on which the drug-coating process is not proceeded in the apparatus 100.

The implant to be coated with the drug is fixedly held in the holding unit 102 through fixtures or holding elements. In an example, the implant may be fixed in the holding unit 102 using a pair of collets. The pair of collets, in an example, may constitute of a top collet and a bottom collet, which securely hold or fix the implant from a top end of the implant and a bottom end of the implant, respectively. The arrangement and the configuration of components of the holding unit 102 for holding the implant are described later in the description through the illustration in FIG. 2.

The apparatus 100 further includes a rotary drive 115 (shown in FIG. 1(*b*)) provided for rotating the implant in order to drug-coat the implant. The rotary drive 115, in an implementation, may be magnetically coupled to the holding unit 102 for the purpose of rotation of the collets and, hence, the implant. The coupling of the rotary drive 115 with the holding unit 102 is such that both the collets, i.e., the top collet and the both collet, are rotated by the rotary drive 115. The rotation of the collets in turn rotates the implant for the drug-coating process, in accordance with the present subject matter. In an implementation, the rotary drive 115 is configured to rotate both the collets in conjunction with each other such that the implant is rotated uniformly at a predefined rotational speed. The rotation of collets and, hence, the implant through the rotary drive 115 is further described in detail later in the description with reference to FIG. 2.

In an implementation, the apparatus 100 may include more than one rotary drive coupled to the holding unit 102 for the purpose of rotation of the implant. For example, the apparatus 100 may include two independent rotary drives, such that each of the collets is rotated independently by the individual rotary drive in order to rotate the implant for drug coating. As described above, the two independent rotary drives rotate the collets in conjunction with each other such that the implant is rotated uniformly at a predefined rotational speed.

Further, the spraying unit 104 of the apparatus 100, configured to spray-coat the drug on the implant, includes a spraying device such as a spray gun 106 with an atomizer. As described earlier, the atomizer is provided to convert the drug in the form of substantially small droplets for easy and efficient coating of the drug on the implant. The spray gun 106 includes a feed cup 121, a nozzle 122 and a flow-control rod 123. The feed cup 121 is coupled to the nozzle 122 such that any solution fed in the feed cup 121 is passed through the nozzle 122. For the drug-coating of the implant, the drug is put in the feed cup 121. The drug in the feed cup 121 is atomized by the atomizer for being sprayed onto the implant through the nozzle 122. In an implementation, the drug may be atomized by pressurized air, or by pressured nitrogen gas or by any other similar pressurized gas used for the purposes of atomization. For atomization, the pressurized gas or air is released into the atomizer from an inlet 108. Further, the flow-control rod 123 is coupled with the nozzle 122. The flow-control rod 123 is set at a position, calibrated to control the rate of flow of the drug being sprayed from the nozzle 122.

In an implementation, the apparatus 100 has a swinging mechanism (not shown in FIGS. 1(*a*) and 1(*b*)) coupled to the spraying unit 104, particularly to the spray gun 106, for swinging the spray gun 106 during the spray-coating of the drug on the implant. For this, the swinging mechanism includes a cam-based swing drive coupled to the spray gun 106. The spray gun 106 is swung along a longitudinal axis of the implant by the swinging mechanism, such that the drug is coated substantially uniformly over the entire circumferential surface of the implant. The direction of swing of the spray gun 106 for spraying the drug onto the circumference of the implant is as shown by an arrow 128. The arrangement of the cam-based swing drive is enclosed within an enclosure 130. The details of the cam-based swing drive for swinging the spray gun 106 during the drug-coating process are described later in the description with reference to FIG. 3.

The swinging mechanism in the apparatus 100 is configured such that the swing of the spray gun 106 can be varied and controlled based on the length of the implant to be coated with the drug. Such a provision facilitates in coating medical implants of varying lengths. For this, in an implementation, as shown in FIGS. 1(*a*) and 1(*b*), the swinging mechanism includes a size selector multiport 110 through which the swing of the spray gun 106 can be varied based on the length of the implant to be coated with the drug. The size selector multiport 110 is coupled to the cam-based swing drive of the swinging mechanism for controlling the angle of swing of the spray gun 106.

As illustrated in FIGS. 1(*a*) and 1(*b*), the size selector multiport 110 includes parallel plates 124-1 and 124-2 (collectively referred to as parallel plates 124) and a guide pin 126. The positioning of parallel plates 124 and the guide pin 126 collectively allow for varying and controlling the swing of the spray gun 106. Each of the parallel plates 124 has multiple slots bored for selecting the angle of swing of the spray gun 106 based on the length of the implant to be coated. In an example, each of the parallel plates 124 may have slots numbered from 1 to 9 calibrated for coating of implants of different lengths, for example, from 8 mm to 40 mm. The slots in the parallel plates 124 are in pairs, i.e. for each slot on one of the parallel plates 124 there is one coinciding slot in the other plate. Each pair of slots in the parallel plates 124 corresponds to and is calibrated for one predefined length of a medical implant to be coated.

For performing the drug-coating on an implant, the user operating the apparatus 100 may select a slot in one of the parallel plates 124, which may be numbered in accordance with the length of the implant to be coated. One of the parallel plates, for example the plate 124-1, is moved by the user such that selected slot coincides with the corresponding slot in the other plate. The guide pin 126 is then inserted in the pair of coinciding slots to hold the parallel plates 124. The alignment and the positioning of the parallel plates 124 by the insertion of the guide pin 126 in the selected and coinciding slots constraints the movement of the cam-based swing drive such that the spray gun 106 is swung between an upper limit and a lower limit based on the length of the implant. The difference of the upper limit and the lower limit is substantially equal to the length of the implant. Such an arrangement of the swinging mechanism in the apparatus 100 substantially ensures that the spray gun 106 sprays the drug only on the implant and thus, no or substantially less amount of the drug is wasted in the drug-coating process.

As mentioned earlier, the control unit 114 is configured to control operational parameters of the apparatus 100. The operational parameters of the apparatus 100 may include rotational speed or RPM of the implant, time period of a spray cycle, on and off of a spray cycle, air or gas pressure for the atomization of drug, swing speed of the spray gun 106 and the like. The control unit 114 is configured to receive a plurality of user inputs such as length of implant to be coated with the drug, size of collets used in the holding unit 102 for holding the implant, and rotational speed of the collets. Based on the plurality of user inputs, the control unit 114 is configured to estimate the operational parameters for the purposes of performing the drug-coating process.

Accordingly, the control unit 114 is coupled to the rotary drive 115. The control unit 114 controls the rotational speed of the rotary drive 115 for controlling the RPM of the implant based on the estimated rotational speed of the implant for drug-coating. In addition, the control unit 114 is coupled to the swinging mechanism, particularly to the cam-based swing drive. The control unit 114 controls the speed of swing of the spray gun 106 based on the estimated swing speed. Furthermore, the control unit 114 is coupled to the spraying unit 104. The control unit 114 controls the time period of spray-coating of the implant based on the estimated time period of spray cycle. For this, the control unit 114 switches on and switch off the spraying unit 104 according to the time period of spray-coating.

In an implementation, the control unit 114 may include a programmable micro-controller for estimating and controlling the operational parameters. The programmable micro-controller of the control unit 114 may be configured to receive the plurality of user inputs as mentioned above, estimate the operational parameters, and then send signals to the swinging mechanism, the spraying unit 104 and the rotary drive 115. The rotary drive 115, the swinging mechanism, and the spraying unit 104 may then operate at values of the estimated operational parameters as communicated by the micro-controller.

As described in foregoing, the apparatus 100 includes the inlet 108 for releasing pressurized air or gas into the atomizer. The pressure of the pressurized air or gas may be controlled for different spray cycles. In an example, the pressure of the pressurized air through the inlet 108 is controlled by means of a pressure regulator 132. The control unit 114 estimates the pressure of air or gas, as an operational parameter, at which the pressurized air or gas is to be passed through the inlet 108 for the drug-coating process. The control unit 114 estimates the pressure based on the plurality of user inputs. Based on the estimated pressure, the control unit 114 controls the pressure regulator 132 for controlling the air or gas pressure through the inlet 108, such that proper atomization of the drug by the atomizer is achieved and appropriate amount of drug is sprayed out from the nozzle 122. The air or gas pressure is also controlled to control a cone angle of the drug spray being released from the spray gun 106. For attaining the pressure value estimated by the control unit 114, pressure valves coupled to the inlet 108 are operated.

Further, in an implementation, the control unit 114 may further include various display devices for displaying the operational parameters during the spray cycle for the implant. In an implementation, the control unit 114 may include multiple switches, such as push buttons and selector knobs, for controlling various operations, say for power on and off, coat cycle start-stop, standby, and wash cycle start-stop.

As shown in FIGS. 1(*b*), the control unit 114 includes a push button 134 for switching on and off of the apparatus 100, and a selector knob 136 for selecting between starting and stopping of the spray cycle for the implant or starting and stopping of the wash cycle for the implant.

In an implementation, the control unit 114 is configured to put the apparatus 100 in a standby mode for washing and cleaning of the spray gun 106, and particularly the nozzle 122. In the standby mode, all operations of the apparatus 100 are paused or stopped by the control unit 114. In an example, the control unit 114 may put the apparatus 100 in the standby mode automatically before or after every spray cycle. In an example, the control unit 114 may put the apparatus 100 in the standby mode periodically after a predefined number of spray cycles, for instance after every 2 to 5 spray cycles. In another example, the control unit 114 may put the apparatus 100 in the standby mode periodically after performing the drug spray for a predefined time duration, like after 30 minutes to 1 hour for drug spray. Further, the control unit 114 may put the apparatus 100 in the standby mode based on an input received from the user. For this, the user can operate the selector knob 136 to set it for the wash cycle.

To perform a wash cycle for cleaning the nozzle 122, a cleaning solution, for example dichloromethane, is put in the feed cup 121 provided in the spray gun 106. For the purpose of cleaning, the flow-control rod 123 coupled to the nozzle 122 is operated or unscrewed to achieve a maximum flow-rate for the cleaning solution through the nozzle 122. The wash cycle completes as the entire cleaning solution is passed through the nozzle 122. In an implementation, the wash cycle may be repeated multiple times, for example two to three times, such that the nozzle 122 is substantially cleansed by the cleaning solution. After the wash cycle(s) is completed, the flow-control rod 123 is operated or screwed back to set the position calibrated for the rate of flow of the drug through the nozzle 122.

In an implementation, the control unit 114 of the apparatus 100 may include multiple display devices for displaying progress of each operation of a coating process, for displaying the operational parameters for each step of the coating process, and also displaying warnings for faulty operations. The display devices may include a Liquid Crystal Display (LCD) 140 and a pressure digital display 142. The LCD 140 may display values, say the time of the coating process, amount of drug coated on the implant, speed of rotation of the collets, and the like. The LCD 140 may also display messages such as "coat cycle complete", "standby for wash cycle", "door interlock open", and the like. The pressure digital display 142 may display the value of pressure of the pressurized air or gas that may be released in the atomizer.

Further, in an implementation, the spraying unit 104 includes a Light Emitting Diode (LED) panel 144 for indicating start and stoppage of the spray of drug from the spray gun 106.

The apparatus 100 may also include, in an implementation, a suction and filter panel 116. The suction operation of the suction and filter panel 116 provides an exhaust system to remove waste drug from the apparatus 100 during coating of the drug. The waste drug is the drug that is not coated on the implant 206. The suction and filter panel 116 removes the waste drug by sucking the sprayed drug that does not get coated on the implant during the spray coating process. The drug sucked by the suction and filter panel 116 is taken out from the apparatus 100 in a controlled manner. This prevents the uncoated drug from freely escaping from the apparatus 100 and substantially ensures that no drug is released outside the apparatus 100 into the surrounding environment during the coating process. Further, the filtering operation of the suction and filter panel 116 provides to filter air that may enter from outside into the apparatus 100. Air may enter into the apparatus 100 due to a reverse pressure condition which may occur in case of faulty operation of the apparatus 100. This prevents outside contaminated air from entering into the apparatus 100, which in turn ensures that the coating of drug on the implant is substantially free from contamination.

Further, the apparatus 100 may include a spray gun interlock 118 and a holding unit interlock 120 in order to safely and securely fix the spraying unit 104 and the holding unit 102, respectively, onto the surface of the apparatus 100.

Figure 2:
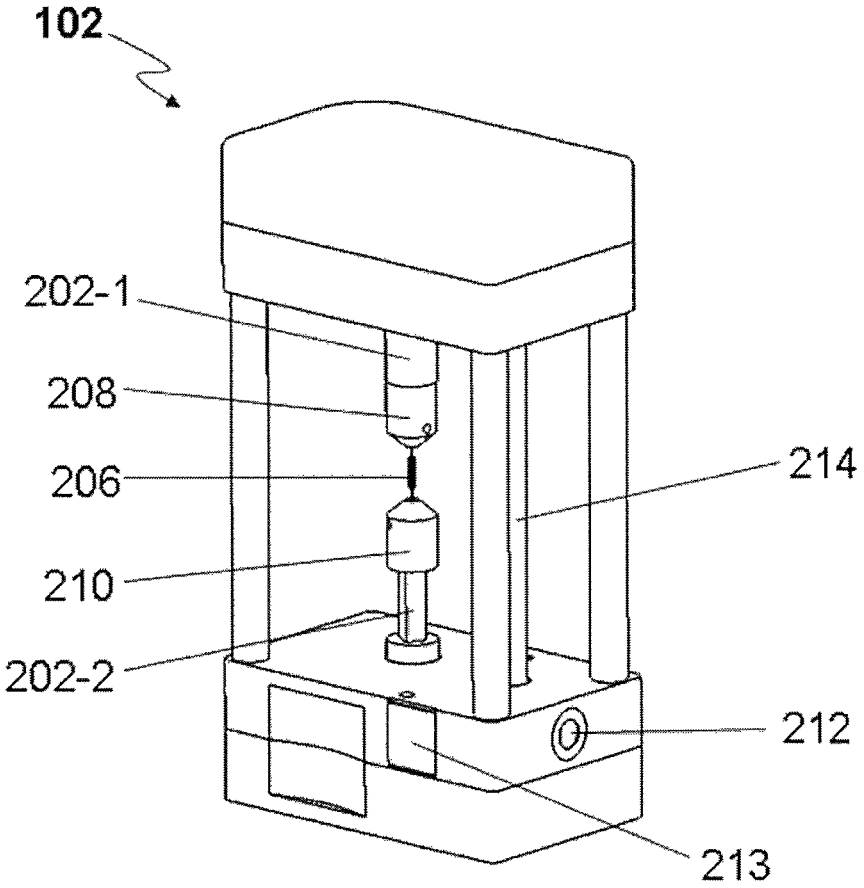
FIG. 2 illustrates a perspective view of the holding unit of the apparatus, according to an implementation of the present subject matter.

FIG. 2 illustrates the holding unit 102 for holding the implant 206 to be coated with the drug, according to an implementation of the present subject matter. As mentioned earlier, the holding unit 102 has a top collet 202-1 and a bottom collet 202-2, collectively referred to as collets 202, for securely holding the implant 206 from a top end and a bottom end of the implant 206. The size of the collets 202 may depend on the length of implant to be held between the collets 202. In an example, the collets 202 may be made of stainless steel. The collets 202 may be coupled to the holding unit 102 by means of a push-pull mechanism.

Further, the top collet 202-1 is coupled to an upper locator 208 for coupling the top end of the implant 206. Similarly, the bottom collet 202-2 is coupled to a bottom locator 210 for coupling the bottom end of the implant 206. The upper locator 208 and the bottom locator 210 may be coupled to the top collet 202-1 and the bottom collet 202-2, respectively, by means of a magnetic coupling or by means of a vacuum seal. The top end and the bottom end of the implant 206 are coupled with separate thin metallic wires. The free ends of the thin metallic wires are coupled with the upper locator 208 and the bottom locator 210 for holding the implant 206 in the holding unit 102.

As described in foregoing, the holding unit 102 is detachably attached to the apparatus 100 through the sliding mechanism. Further to the sliding mechanism, in an implementation, the holding unit 102 is coupled to the apparatus 100 by means of a magnetic coupling. The holding unit 102 has a magnet 212 that provides the magnetic coupling with the apparatus 100. The coupling through the magnet 212 facilitates in providing substantial stability to the holding unit 102 during the drug coating process.

The holding unit 102 has a metal element 213, as shown in FIG. 2, which aligns with the proximity sensor 109 (shown in FIG. 1(*b*)) when the holding unit 102 is attached to the apparatus 100. Based on the proximity of the metal element 213 with respect to the proximity sensor 109, the alignment or the misalignment of the holding unit 102 is determined by the proximity sensor 109. In an example, the detection or the determination of alignment of the holding unit 102 by the proximity sensor 109 with respect to the metal element 213 is contactless.

Further, the holding unit 102 is attached to the apparatus 100 such that the rotary drive 115 gets coupled to the holding unit 102. The holding unit 102 has a drive shaft 214, as shown, which couples with the rotary drive 115. As the apparatus 100 is operated for the drug coating on the implant 206, the drive shaft 214 is rotated by the rotary drive 115. The drive shaft 214 is coupled with the collets 202 in such a manner that the rotation of the shaft 214 rotates the collets 202, i.e., the upper collet 202-1 and the bottom collet 202-2, in conjunction with each other. In an example, the drive shaft 214 is coupled with the collets 202 through one or more drive gears. The rotating upper collet 202-1 rotates the upper locator 208 and the rotating bottom collet 202-2 rotates the bottom locator 210. The rotation of the upper locator 208 and the bottom locator 210 rotates the implant 206 for coating of the drug.

Figure 3:
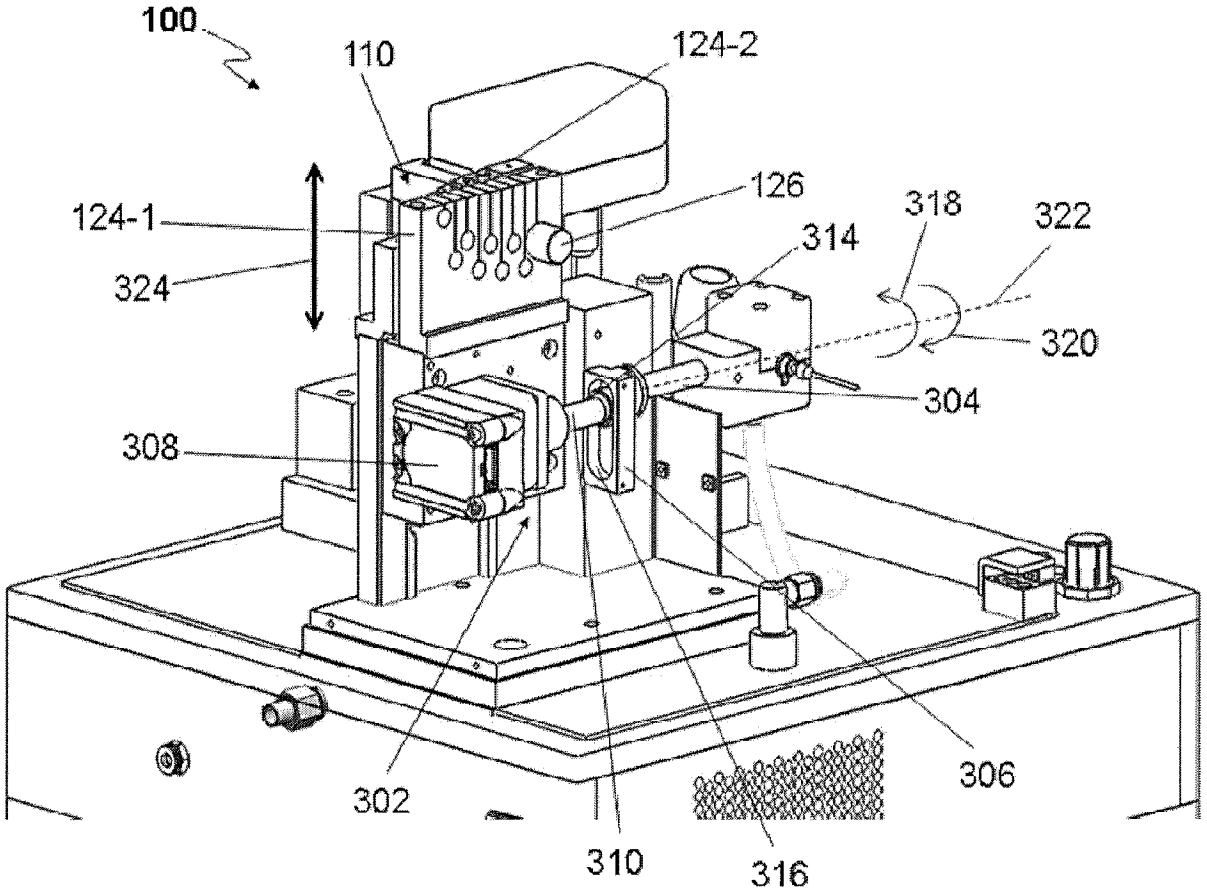
FIG. 3 illustrates components of a cam-based swing drive of the apparatus, according to an implementation of the present subject matter.

FIG. 3 illustrates components of the cam-based swing drive of the apparatus 100, according to an implementation of the present subject matter. The cam-based swing drive includes a cam drive 302 coupled with a swing rod 304 through a connector element 306 for providing and controlling the angle of swing of the spray gun 106 for coating of drug on the implant 206.

The cam drive 302 includes a stepper motor 308 and a cam shaft 310. The cam shaft 310 is coupled eccentrically with stepper motor 308. With the eccentric coupling, the cam shaft 310 is eccentrically rotated by the stepper motor 308.

Further, the cam shaft 310 is eccentrically coupled with the swing rod 304 such that the rotation of the cam shaft 310 swings or oscillated the swing rod 304. For this, the cam shaft 310 is coupled with an eccentric bearing 314, the eccentric bearing 314 being at an end distal to the stepper motor 308. The eccentric bearing 314 is fitted in to an opening 316 in the connector element 306 to operably couple the cam shaft 310 with the connector element 306. Further, the connector element 306 is, in turn, fixedly coupled to the swing rod 304 such that the connector element 306 and the swing rod 304 move in conjunction with each other. The swing rod is further fixedly coupled with the spray gun 106, as shown in FIG. 3.

The description below describes the operation of the swinging mechanism for swinging the spray gun 106 during the drug-coating process. As the apparatus 100 is operated for the drug-coating process, the stepper motor 308 operates to rotate the cam shaft 310. The cam shaft 310 rotates eccentrically, performing a circular motion, about an axis passing through the centre of the stepper motor 308 and substantially perpendicular to a vertical plane. In an example, the cam shaft 310 rotates in the clockwise direction or in the anti-clockwise direction depending on the direction of operation of the stepper motor 308. Due to the eccentric rotation of cam shaft 310, the connector element 306 swings or oscillates, in directions marked by arrows 318 and 320, about a longitudinal axis 322 of the swing rod 304.

Such swinging or oscillatory motion of the connector element 306 causes the swing rod 304 to swing about the longitudinal axis 322 in conjunction with the connector element 306. In turn, such motion of the swing rod 304 causes the spray gun 106 and the nozzle 122 to swing about the longitudinal axis 322 and along the longitudinal axis (not shown) of the implant 206. As may be understood, for the complete 360° eccentric rotation of the cam shaft 310, the connector element 306 and the swing rod 304 perform one complete oscillation about the longitudinal axis 322. With this, the spray gun 106 performs the swing movement such that the drug spray from the nozzle 122 covers the lengths of the implant 206 twice.

The swinging motion of the spray gun 106 and the nozzle 122 may be provided to vary an angle of spray from the spray gun 106 for coating the drug on the implant 206. The angle of spray may be varied based upon the length of the implant 206.

As described in foregoing, the swinging mechanism provides for swinging the spray gun 106 by an angle depending on the length of the implant 206 to be coated. The swing is substantially between the top end and the bottom end of the implant 206. The angle of swing of the spray gun 106 depends on the distance between the longitudinal axis of cam shaft 310 and the longitudinal axis 322 of the swing rod 304. The larger the distance the larger is the angle of swing.

The swinging mechanism has the size selector multiport 110 through which the angle of swing of the spray gun 106 is varied based on the length of the implant 206 to be coated. As shown in FIG. 3, the stepper motor 308 of the cam drive 302 is coupled with the parallel plate 124-1. The parallel plate 124-1, is movable along a direction 324. The cam drive 302, including the stepper motor 308 and the cam shaft 310, moves along with the parallel plate 124-1. The interface of the eccentric bearing 314 and the opening 316 of the connector element 306 has a substantially less friction such that the eccentric bearing 314 is movable along the direction 324 within the opening 316.

As mentioned earlier, based on the length of the implant 206 to be coated, the user can select a slot on one of the parallel plates 124, the slot calibrated for that length of the implant 206. Accordingly, the user can move the parallel plate 124-1 along the direction 324 till the selected slot coincides with the corresponding slot in the other plate 124-2. With the movement of the parallel plate 124-2, the cam drive 302 is moved along the direction 324 to set the distance between the cam shaft 310 and the swing rod 304. The guide pin 126 is inserted in the pair of coinciding slots and the distance between the cam shaft 310 and the swing rod 304 is set.

Different positions at which different pairs of slots in the parallel plates 124 coincide with each other are calibrated for different lengths of implants for being coated by the apparatus 100. These different positions of coinciding slots in the parallel plates 124 vary the distance between the cam shaft 310 and the swing rod 304 to vary the angle of swing of the spray gun 106 according to the length of the implant to be coated.

The description below describes an example of operation of the apparatus 100 for coating of drug on an implant 206. At first the apparatus 100 is switch on and the spray gun 106 may be cleaned in accordance with the procedure described earlier. For coating the drug on the implant 206, the size selector multiport 110 is set to position the cam drive 302 based on the length of the implant 206. After setting the size selector multiport 110 the holding unit 102 is securely fixed on the apparatus 100, and the selector knob 136 is moved to the coat cycle position in order to start the coating of the implant 206 with the drug. As the selector knob 136 is set to the coat cycle position, the cam drive 302 and the swing rod 304 are operated by the control unit 114 to swing the spray gun. Also, the rotary drive 115 is operated by the control unit 114 to rotate the implant 206. The pressurize air or gas is passed through the spray gun 106 to the atomized the drug, and the atomized drug is sprayed out from the nozzle 122. The drug is coated on the implant 206 through the swing movement of the spray gun 106 and the rotation of the implant 206. Depending on the time duration of spray estimated by the control unit 114, the operations of the spray gun 106, the rotary drive 115 and the cam drive 302 are stopped by the control unit 114 to complete the spray cycle for the implant 206.

Since, the apparatus 100 of the present subject matter allows for mechanically and electronically controlling each operation of the coating process for coating the implant 206, wastage of the drug sprayed on the implant 206 is minimized as well as uniform coating of the drug on the implant 206 is obtained. Further, as the holding unit 102 is detachably attached to the apparatus 100, when a spray cycle for the implant 206 is in process, another implant to be coated may be readied for coating by fixing the another implant in another holding unit. Furthermore, the collets 202 of the holding unit 102 may be of different sizes in order to sustain mechanical stresses developed inside the implant 206 because of the rotation of the implant 206.

Each operational parameter may be fed as an input to the micro-controller of the control unit 114, thus facilitating proper coating of the drug on the implant 206 with minimum human intervention. Additionally, the swinging mechanism provides for controlling and varying the swinging motion of the spray gun 106, and hence the nozzle 122, such that implants of varying lengths may be easily coated.

Although implementations for the apparatus 100 have been described in language specific to structural features, it is to be understood that the invention is not necessarily limited to the specific features described. Rather, the specific features are disclosed and explained in the context of a few implementations for the apparatus 100.

Other advantages of the apparatus 100 of the present subject matter will become better understood from the description and claims of an exemplary implementation of the apparatus 100. The apparatus 100 of the present subject matter is not restricted to the implementations that are mentioned above in the description.

Although the subject matter has been described with reference to specific implementations, this description is not meant to be construed in a limiting sense. Various modifications of the disclosed implementations, as well as alternate implementations of the subject matter, will become apparent to persons skilled in the art upon reference to the description of the subject matter. It is therefore contemplated that such modifications can be made without departing from the spirit or scope of the present subject matter as defined.

We claim:

1. An apparatus for coating an implant with a drug, the apparatus comprising:

a detachable holding unit comprising:

a thin spring wire;

locators coupled to one of the collets attached through a coupling to the holding unit;

a top collet for holding the implant from a top end of the implant; and a bottom collet for holding the implant from a bottom end of the implant;

at least one rotary drive coupled to the holding unit to the holding unit for rotating the top collet a bottom collet and the implant in conjunction with each other;

a spraying unit to spray-coat the drug on the implant, wherein the spraying unit comprises a spray gun through which the drug is spray coated on the implant; and a swinging mechanism coupled to the spray gun to swing the spray gun along a longitudinal axis of the implant for coating the drug, wherein the swinging mechanism comprises:

a stepper motor;

a cam shaft coupled eccentrically to the stepper motor, wherein the cam shaft is rotated eccentrically by the stepper motor; and a swing rod coupled eccentrically to the cam shaft and coupled to the spray gun, wherein eccentric rotation of the cam shaft swings the swing rod and the spray gun.

2. The apparatus as claimed in claim 1, wherein the at least one rotary drive rotates the top collet and the bottom collet in conjunction with each other.

3. The apparatus as claimed in claim 1, wherein the apparatus comprises a control unit coupled to the at least one rotary drive, the control unit controls a rotational speed of the at least one rotary drive for controlling number of rotations per minute of the implant.

4. The apparatus as claimed in claim 1, wherein the holding unit is detachably attached to the apparatus through a sliding mechanism.

5. The apparatus as claimed in claim 1, wherein the apparatus comprises a proximity sensor to determine alignment of the holding unit attached for coating the drug on the implant.

6. The apparatus as claimed in claim 1, wherein the apparatus comprises a control unit coupled to the swinging mechanism; the control unit controls a speed of swing of the spay gun.

7. The apparatus as claimed in claim 1, wherein the spray gun comprises:

an atomizer to atomize the drug; and an inlet to provide one of a pressurized air and a pressurized gas to the atomizer for atomizing the drug, wherein the apparatus comprises a control unit coupled to the spraying unit, wherein the control unit controls pressure of one of the pressurized air and the pressurized gas provided for the atomization.

8. The apparatus as claimed in claim 1, wherein the apparatus comprises: a suction and filter panel to remove waste drug from the apparatus during coating of the drug.

9. The apparatus as claimed in claim 8, wherein the suction and filter panel filters air that enters from outside into the apparatus when a reverse pressure condition occurs in the apparatus.

10. The apparatus as claimed in claim 1, wherein the apparatus comprises a control unit coupled to the spaying unit, the control unit controls time period of spray-coating of the implant.

11. The apparatus as claimed in claim 1, wherein the apparatus comprises a control unit, wherein the control unit puts the apparatus in a standby mode for cleaning the spray gun.

12. The apparatus as claimed in claim 11, wherein the control unit puts the apparatus in the standby mode after the apparatus has performed a predefined number of spray cycles.

13. The apparatus as claimed in claim 11 wherein the control unit puts the apparatus in the standby mode after the apparatus has performed drug spraying for predefined time duration.

14. The apparatus as claimed in claim 11, wherein the control unit puts the apparatus in the standby mode based on an input for cleaning received from a user.

15. The apparatus as claimed in claim 1, wherein the apparatus comprises a control unit, wherein the control unit receives a plurality of user inputs to control operational parameters of the apparatus, the plurality of user inputs comprises length of implant to be coated, size of collets, and rotational speed of collets.

* * * * *